US006363593B1

(12) United States Patent
Duval et al.

(10) Patent No.: US 6,363,593 B1
(45) Date of Patent: Apr. 2, 2002

(54) FEEDING A NEEDLING MACHINE WITH A CONTINUOUS SPIRAL STRIP

(75) Inventors: Renaud Duval, Les Cheres; Thierry Marjollet, Besancon; Robert Jean, Fouqueville, all of (FR)

(73) Assignee: Messier-Bugatti, Velizy-Villacoublay (FR)

( * ) Notice: Subject to any disclaimer, the term of this patent is extended or adjusted under 35 U.S.C. 154(b) by 0 days.

(21) Appl. No.: 09/900,275

(22) Filed: Jul. 6, 2001

(30) Foreign Application Priority Data

Apr. 30, 2001 (FR) ..... 01 05796

(51) Int. Cl.[7] ..... D01H 1/46
(52) U.S. Cl. ..... 28/107
(58) Field of Search ..... 28/107, 108, 109, 28/110, 111, 112, 113, 114, 115

(56) References Cited

U.S. PATENT DOCUMENTS 4,891,870 A * 1/1990 Muller ..... 28/107
5,664,305 A * 9/1997 Lawton et al. ..... 28/107
6,009,605 A * 7/2000 Olry et al. ..... 28/107
6,183,583 B1 * 2/2001 Duval et al. ..... 28/107
6,248,417 B1 * 6/2001 Ponsolle et al. ..... 28/107

FOREIGN PATENT DOCUMENTS

WO WO 96/33295 10/1996

* cited by examiner

*Primary Examiner*—Danny Worrell
(74) *Attorney, Agent, or Firm*—Weingarten, Schurgin, Gagnebin & Lebovici LLP

(57) ABSTRACT

A machine for needling a textile structure built up from a wound strip of material to be needled that is delivered by strip supply means comprising a storage drum containing said wound strip of textile material, an unwinding assembly for continuously extracting said strip from said storage drum, and a helical chute or "twist" for taking up said extracted strip unwound from said drum and for bringing it up to a needling table where there are friction drive means. The storage drum and the helical chute have the same axis C as the needling table.

10 Claims, 5 Drawing Sheets

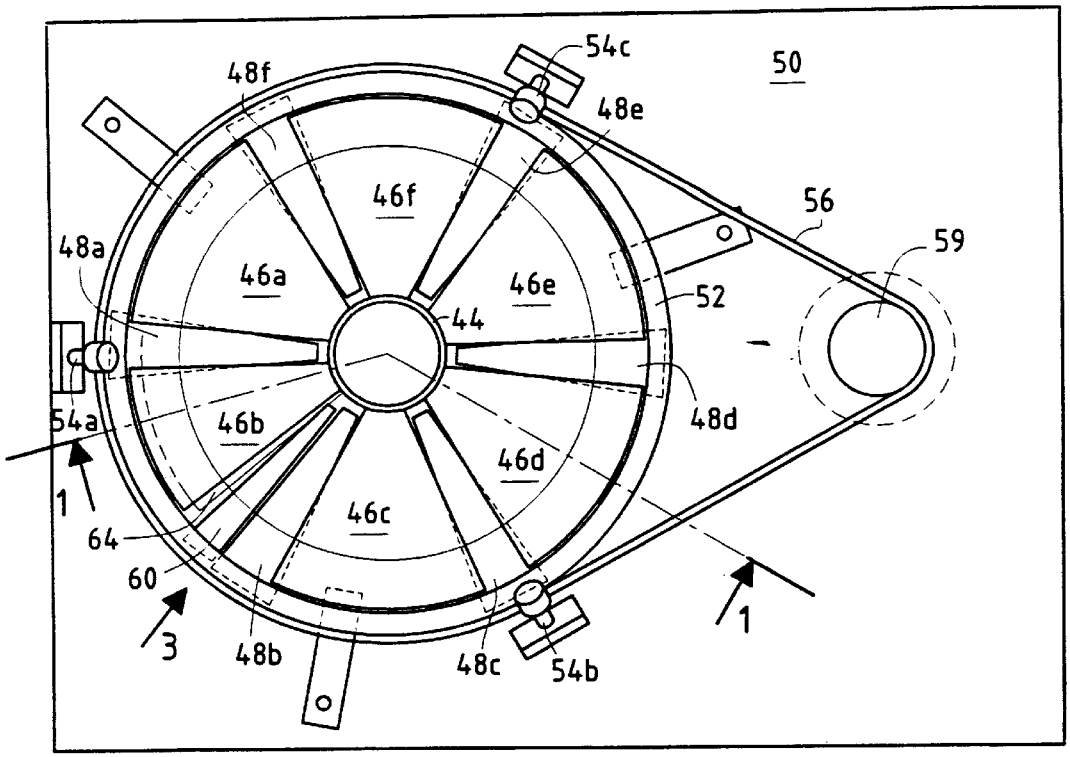
FIG.2
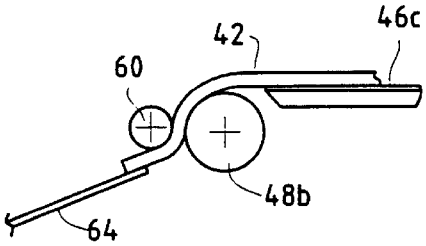
FIG.3
FIG.2A
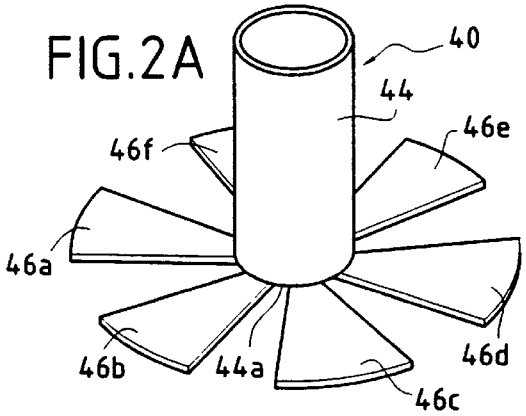
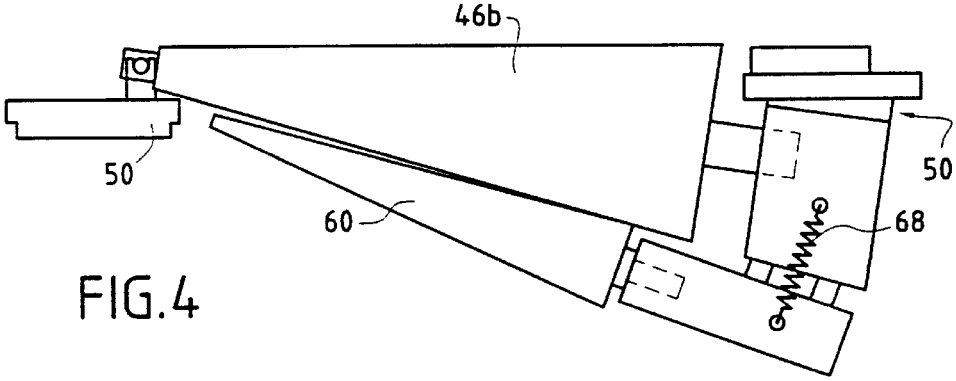
FIG.4

FEEDING A NEEDLING MACHINE WITH A CONTINUOUS SPIRAL STRIP

FIELD OF THE INVENTION

The present invention relates to the field of needled textile structures and it relates more particularly to a device for automatically feeding a circular type needling machine with a textile strip.

PRIOR ART

In a circular type needling machine, the annular preform for needling is placed on a needling table and is rotated by drive means, usually friction drive means, with which it is continuously in contact. That type of machine is fed flat level with the needling table from a strip of material for needling that is taken from unwinding apparatus external to the needling machine. Such flat feed nevertheless gives rise to a particular difficulty, especially when preforms are to be produced automatically without manual intervention.

OBJECT AND DEFINITION OF THE INVENTION

The present invention thus sets out to solve this specific problem with a needling machine that includes an automatic feeder device. An object of the invention is also to provide such a device without significantly altering the overall size of a circular type needling machine.

These objects are achieved by a machine for needling a textile structure built up from a wound strip of material to be needled that is delivered by strip supply means, wherein said strip supply means comprise a storage drum containing said wound strip of textile material, an unwinding assembly for continuously extracting said strip from said storage drum, and a helical chute or "twist" for taking up said extracted strip unwound from said drum and for bringing it up to a needling table where there are friction drive means. Said storage drum and said helical chute have the same axis C as said needling table.

Thus, with this particular structure, it is possible to feed textile material easily and automatically while conserving the same floor space or "footprint" for the needling machine. In addition, the strip is well guided all the way to the needling table.

The helical chute for feeding said unwound strip of textile material to said needling table is secured to the frame of the machine and comprises two successive portions separated by a gap to allow cutting means to pass to cut said unwound strip.

The unwound strip of textile material is kept in contact with said helical chute while it is being fed to said needling table by two separate drive assemblies disposed respectively upstream and downstream from said means for cutting said strip.

Downstream from said downstream drive assembly, the machine preferably further includes a jockey roller hinged to said frame and designed to guarantee regular tension on said unwound strip of textile material after it has been cut by said cutting means and before it is taken up on said needling table by said friction drive means.

Each drive assembly comprises wheels placed one after another so as to fit closely to the helical shape of said feed chute for said unwound strip of textile material.

Advantageously, each drive assembly has at least two wheels each mounted on a support secured to said frame and connected to one another by a drive belt, at least one of said wheels in each assembly being connected to a motor and gear box unit by means of a universal joint.

In a preferred embodiment, the assembly device for unwinding said wound strip of textile material includes a plurality of conical rollers rotated by friction from a ring centered on wheels secured to said frame and rotated by a belt driven by a motor, and on which said wound strip of textile material rests once said storage drum has been installed on said machine. It may further include a presser roller held against one of said conical drive rollers by a resilient element acting in traction so as to enable a free end of said unwound strip of textile material to be taken up and guided towards said helical chute.

The storage drum includes a central hub rotating about an axis of rotation having a reception tray fixed to the bottom portion thereof (bottom of the drum), which reception tray is provided with openings for receiving said conical rollers for driving said wound strip of textile material.

BRIEF DESCRIPTION OF THE DRAWINGS

The characteristics and advantages of the present invention appear better from the following description given by way of non-limiting indication and made with reference to the accompanying drawings, in which:

FIG. 2 is a plan view of the FIG. 1 needling machine showing the unwinding assembly;

FIG. 2A shows a drum for storing the textile material;

FIG. 3 is a view on plane III of FIG. 2;

FIG. 4 shows rollers for taking up textile material at the outlet from the unwinding assembly;

DETAILED DESCRIPTION OF A PREFERRED EMBODIMENT

Figure 1:
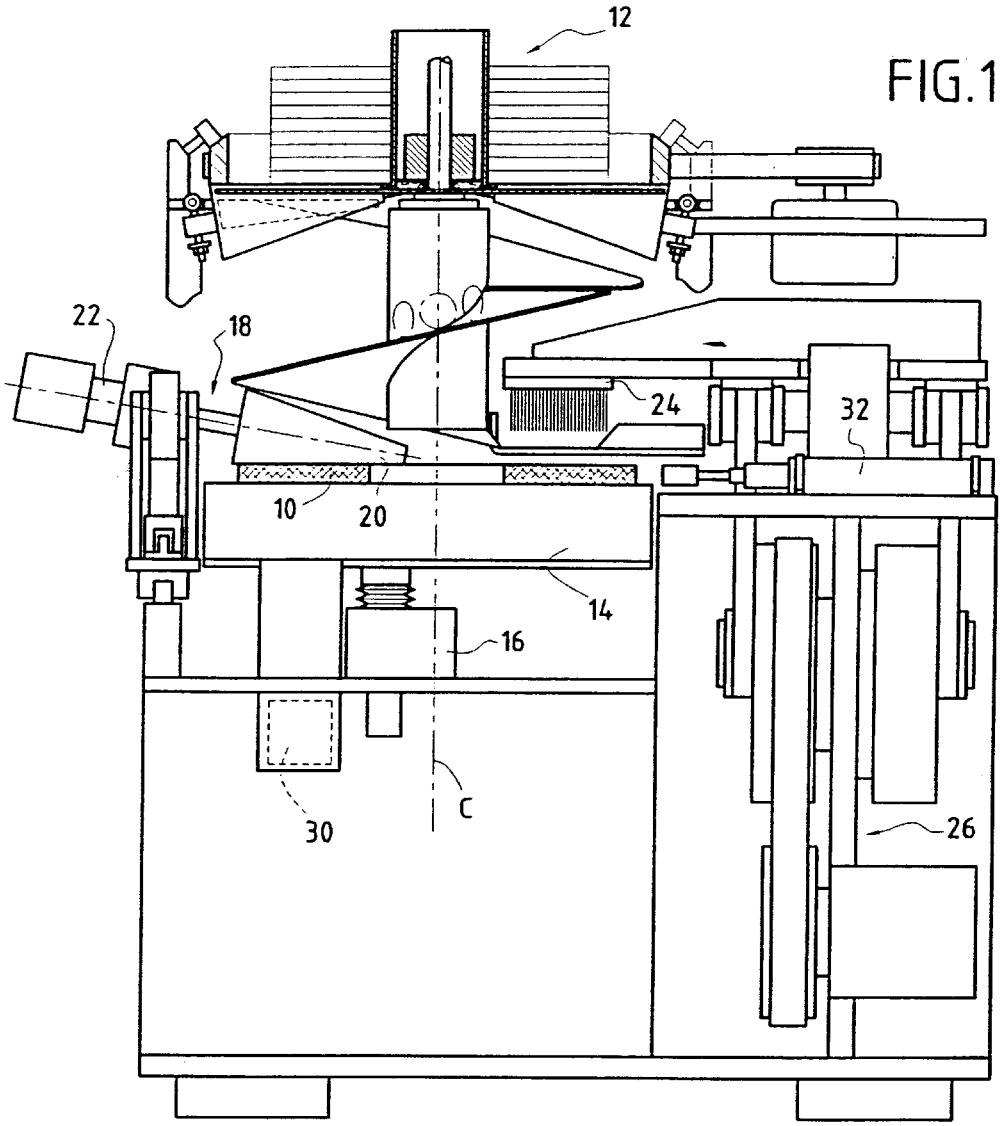
FIG. 1 is a general elevation view of a needling machine including an automatic feeder device of the invention.

FIG. 1 is a diagram showing a circular type needling machine for needling a textile structure or annular preform made up from a wound strip of woven or non-woven textile material for needling, and provided with an automatic feeder device of the invention.

This machine is for needling textile structures 10 made from a strip of textile material to be needled that is delivered continuously by supply means 12 conventionally comprises a needling table 14 forming a winding platen onto which the strip of textile material is placed and which is vertically movable under drive from motion transmission means 16 while the strip is being wound out. Drive means 18, advantageously constituted by two conical rollers 20 each actuated by an independent motor and gear box unit 22 and preferably disposed at 120° intervals above said table, then serve to rotate said strip of textile material on the needling table by friction drive.

The strip is needled by a needling head 24 comprising a determined number of barbed needles placed above the needling table between two of the three conical drive rollers.

To enable the various superposed layers of textile material to be needled to one another, this needling head is driven with vertical reciprocating motion by conventional drive means 26. Cutting means 28 (see FIG. 5) placed upstream from the needling zone are also provided to cut the strip once a predetermined final thickness has been obtained for the textile structure (sensors that are not shown serve to monitor said thickness accurately as the various layers are built up). Central control means 30 connected to the motion transmission means of the table 16, to the drive means for driving the textile structure 18, to the means for imparting reciprocating motion to the head 26, and to the cutting means 28 serve to provide the control and synchronization necessary for performing a continuous needling process. Once the strip has been cut and the structure has been needled, removal means 32 enable the structure to be pushed off the needling table, e.g. onto a conveyor belt (not shown) in order to transfer it to another station in the manufacturing line, e.g. a heat treatment station of the kind shown in international patent application No. WO 96/33295 and relating to densifying annular stacks.

Figure 1A:
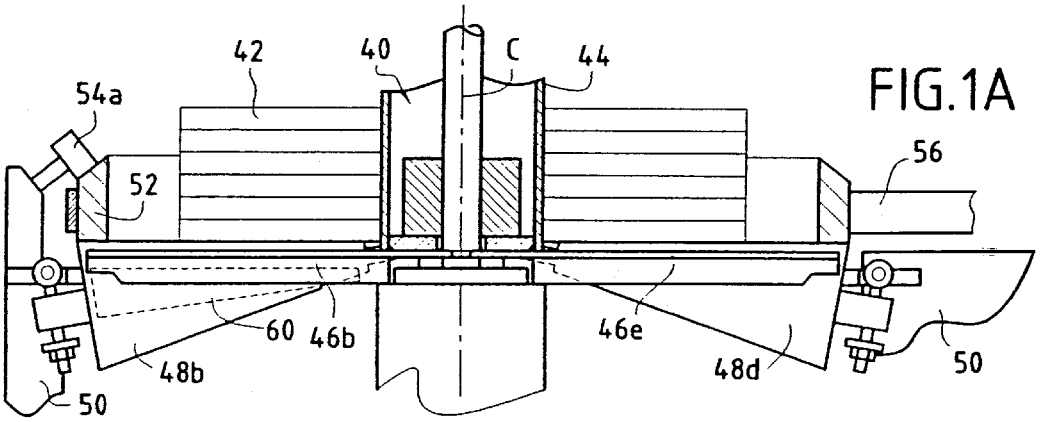
FIG. 1A is a detail view of FIG. 1 showing an assembly for unwinding textile material.

In the invention, and as shown in FIGS. 1A and 2A, the supply means 12 for supplying the material to be needled comprise a storage drum 40 containing a wound strip of textile material 42 and constituted by a central hub 44 about an axis of rotation C with a series of fins 46*a*–46*b* fixed to the bottom portion thereof (also referred to as the bottom of the drum 44*a*) to form a perforated reception tray intended, particularly during transport, to support the strip wound around the central hub.

The storage drum is installed on the needling machine on the same axis C as the needling table, on a top frame 50 of the machine. The openings in the tray (between the fins 46*a*–46*f*) are for receiving the conical rollers 48*a*–48*f* of an unwinding assembly, advantageously belt-driven, serving to extract the strip from the bottom of the drum (see FIG. 2). When the drum is placed on the frame, the conical rollers for driving the unwinding assembly pass a little way through the perforated reception tray forming the bottom of the drum so that these rollers come directly into contact with the textile material to be unwound.

The strip is unwound by the conical drive rollers of the unwinding assembly rotating about their own axes, with this rotation being obtained by friction from a ring 52 centered on wheels 54*a*, 54*b*, 54*c* secured to the machine frame 50 and set into rotation about the axis C by means of a belt 56 driven by a motor 58 (see FIG. 1A) at a speed which is advantageously regulated by the central control means 30, e.g. as a function of the mean speed of rotation of the preform. Naturally, the means for driving the rollers 48 is not limited in any way to the friction system described above, and each roller could be individually driven by a motor and gear box unit controlled from the central control means 30, like the unit 22 used for each conical roller 20, for example.

As shown in FIG. 3, the free end of the unwound strip 42 coming from the storage drum is taken between one of the drive rollers 48*b* and a presser roller 60 held pressed against the drive roller by a resilient element 62 acting in traction (see FIG. 4), and it is guided (downstream) between the fins 46*b*–46*c* beneath the reception tray towards a helical chute 64, 66 or "twist" bringing the textile material onto the needling table 14 in the vicinity of one of the conical drive rollers 20. It should be observed that the end is initially engaged manually between the drive roller and the presser roller when the drum is put into place, but that subsequent operations then take place automatically.

Figure 5:
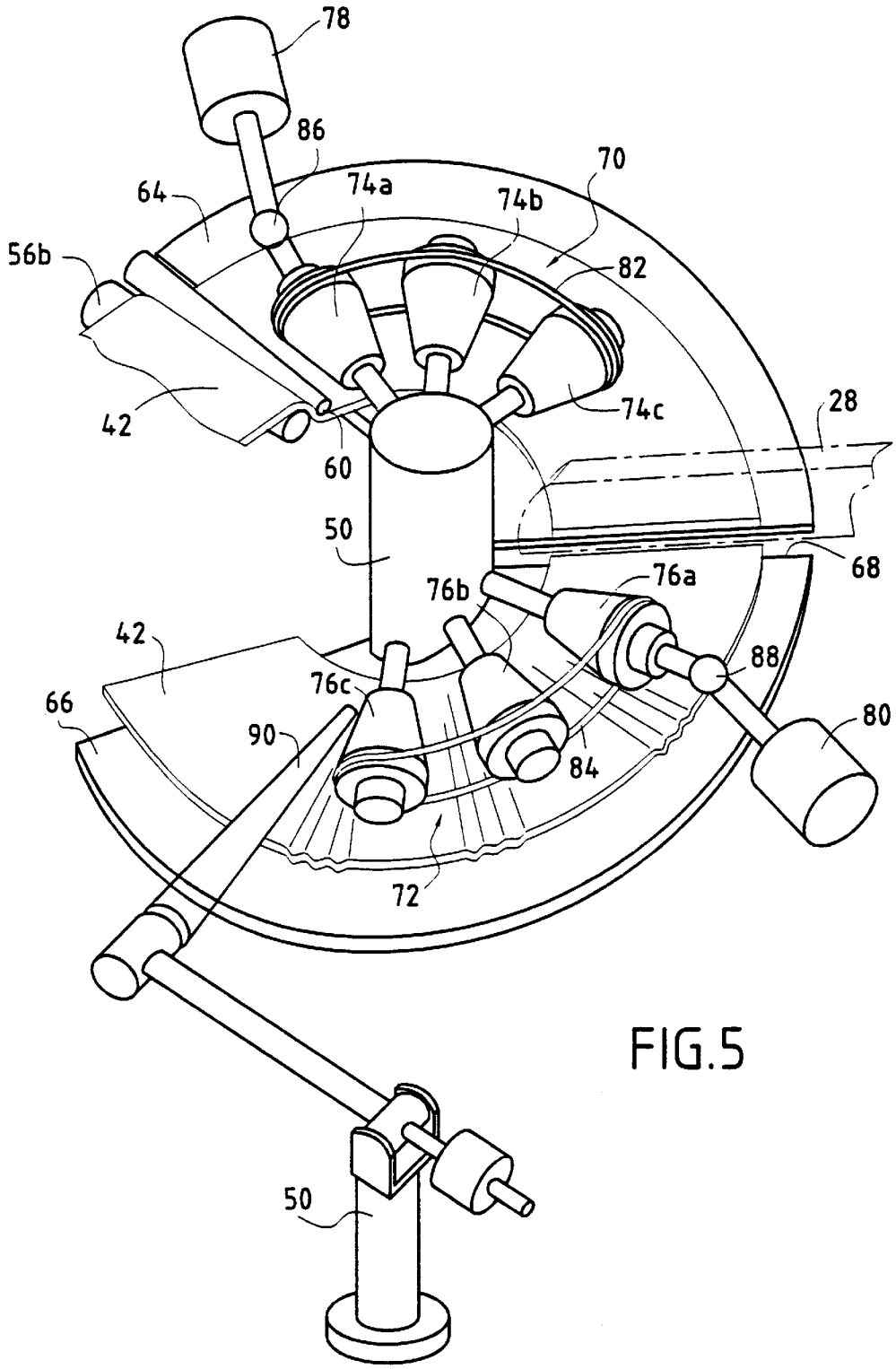
FIG. 5 is a perspective view showing how textile material is driven through a first drive module of the invention.

The path followed by the strip unwound along the helical chute from being extracted from the bottom of the drum until it is deposited on the needling table is shown in FIG. 5 which shows a first embodiment of means for driving it.

The helical chute secured to the frame 50 on the machine comprises two successive portions 64 and 66 which are separated solely by a gap 68 forming a slot to receive the cutting means 28. All along this path, the strip is kept in contact with the chute by drive means which are preferably combined into two separate assemblies 70 and 72 located respectively one (70) upstream from the cutting means 28 and the other (72) downstream therefrom. Each drive assembly is preferably driven by an individual motor and gear box unit 78, 80 controlled by the central control means 30. Nevertheless, it is equally possible to envisage using common motor means for both of them.

Each drive assembly 70, 72 has at least two and preferably three wheels 74*a*, 74*b*, 74*c*; 76*a*, 76*b*, 76*c* mounted on a respective support secured to the frame 50, and they are interconnected by a drive belt 82 or 84 for driving the textile strip along the twist. The number of wheels used for this purpose is essentially a function of the dimensions of the chute, which dimensions are themselves associated with the general size of the needling machine. The wheels are placed one after another so as to fit as closely as possible to the helical shape of the chute. Each motor and gear box unit 78, 80 is connected to one of the wheels 74*a*, 76*a* in the corresponding drive assembly via a universal joint 86, 88.

Downstream from the downstream drive assembly 72 there is a jockey roller 90 hinged to the frame 50 and designed to guarantee uniform tension in the unwound strip of textile material 42 after it has been cut by the cutting means and before it has been taken up on the needling table 14 by one of the conical drive rollers 20. Thus, any slack in said unwound strip is eliminated and the rate of needling can subsequently be controlled accurately.

Figure 6A:
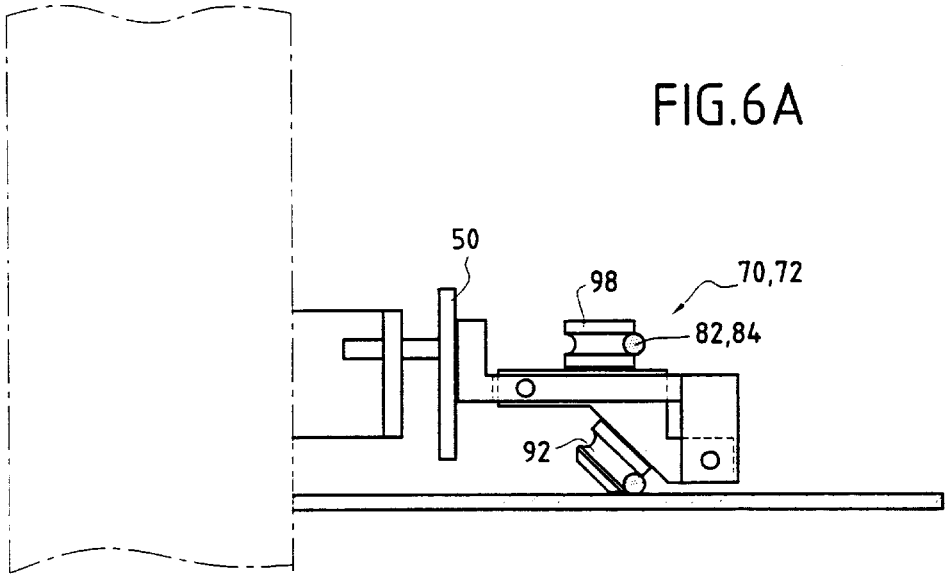
FIGS. 6A and 6B show another embodiment of the textile material drive module.
Figure 6B:
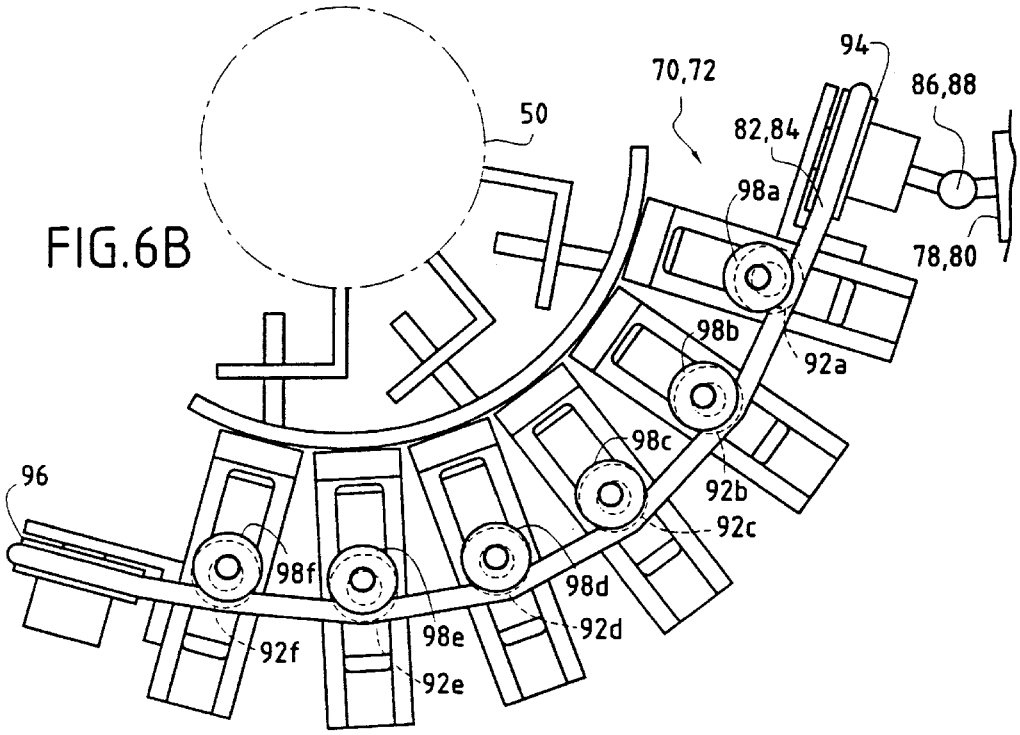

FIGS. 6A and 6B show a second embodiment of separate drive assemblies 70, 72 in which, in order to fit more closely to the shape of the twist 64, the drive belt 82, 84 is mounted on a plurality of sloping wheels 92*a*, 92*b*, 92*c*, 92*d*, 92*e*, 92*f*. Two upright end wheels 94 and 96 and the same plurality of horizontal wheels 98*a*, 98*b*, 98*c*, 98*d*, 98*e*, 98*f* enable the belt to return, with one of the two upright wheels being connected to a motor and gear box unit 78, 80 by means of a universal joint 86, 88. It should be observed that the wheels can be hinged so as to enable them to be moved relative to the median axis of the twist so as to enable the textile sheet to be recentered, should that be necessary.

Figure 7A:
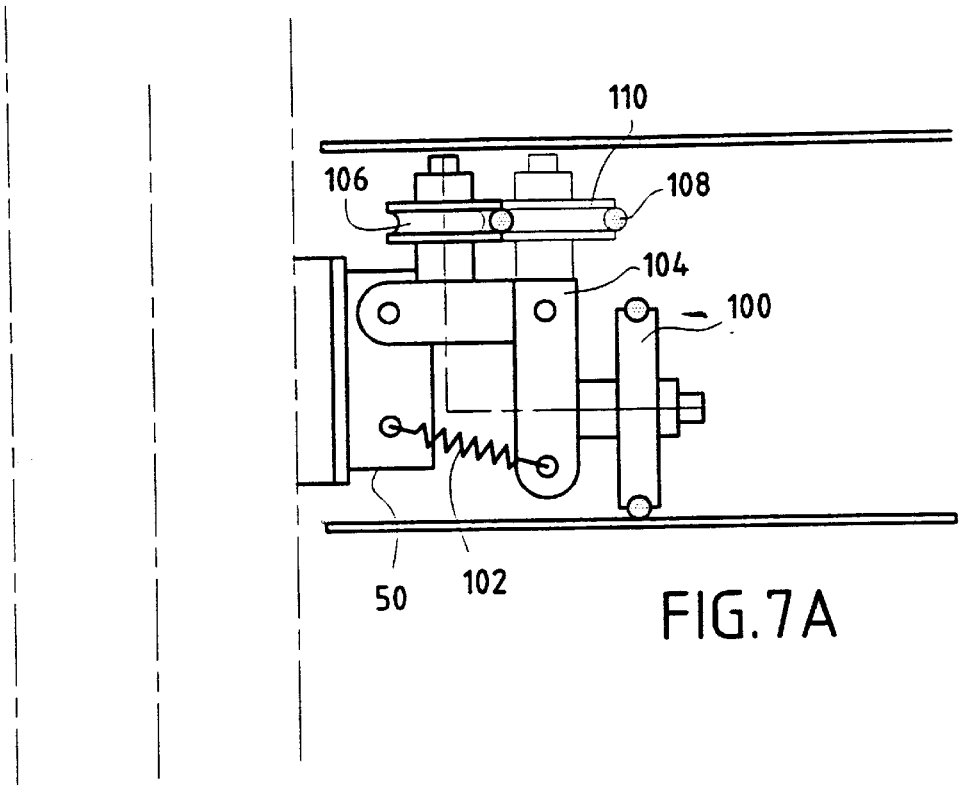
FIGS. 7A and 7B show yet another embodiment of the textile material drive module.
Figure 7B:
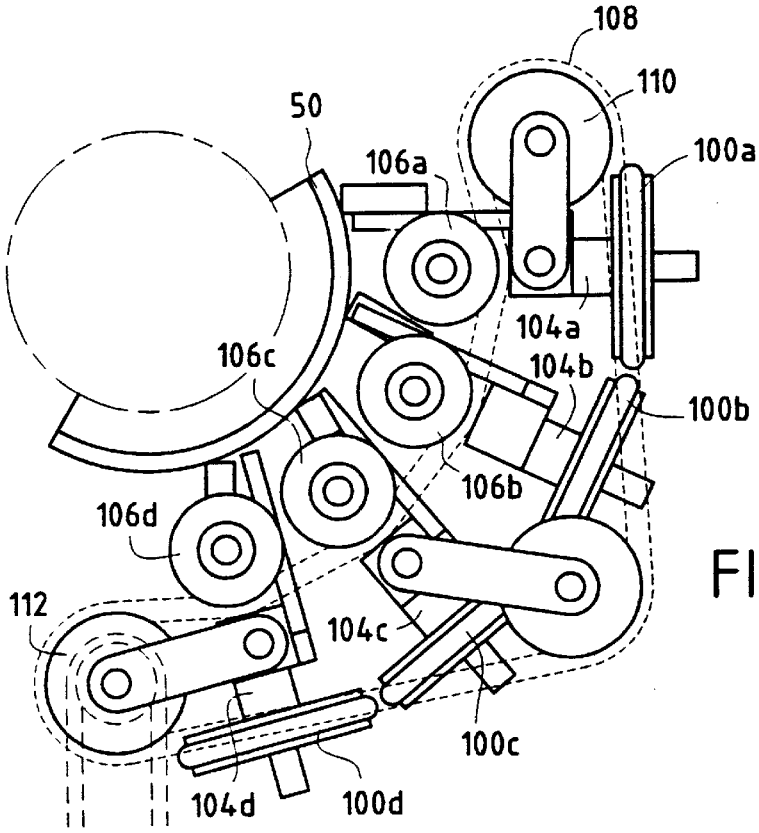

Another embodiment of these drive assemblies is shown in FIGS. 7A and 7B. With this new assembly, the textile material is driven by a plurality of wheels 100*a*, 100*b*, 100*c*, 100*d* independently hinged to the frame 50 (each subjected to the action of a resilient element 102) and the wheels are caused to rotate via respective angle drives 104*a*, 104*b*, 104*c*, 104*d* by a corresponding plurality of horizontal wheels 106*a*, 106*b*, 106*c*, 106*d* driven simultaneously by a belt 108. The belt returns via horizontal end wheels 110, 112 (and possibly also a tensioning wheel 114), with one of the end wheels (e.g. the wheel referenced 112) being connected to a motor and gear box unit 78, 80 by a universal joint, or the like. As in the preceding embodiment, the set of wheels can be hinged to enable the wheels to move relative to the median axis of the twist.

What is claimed is:

1. A machine for needling a textile structure built up from a wound strip of material to be needled that is delivered by strip supply means, said machine comprising a needling table, strip supply means for delivering a strip of material to be needled to said needling table and friction drive means for driving said textile structure on said needling table, wherein said strip supply means comprise a storage drum containing said wound strip of textile material, an unwinding assembly for continuously extracting said strip from said storage drum, and a helical chute or "twist" for taking up said extracted strip unwound from said drum and for bringing it to said needling table at a location where said friction drive means are provided.

2. A needling machine according to claim 1, wherein said storage drum and said helical chute have the same axis C as said needling table.

3. A needling machine according to claim 1, wherein said helical chute for feeding said unwound strip of textile material to said needling table is secured to the frame of the machine and comprises two successive portions separated by a gap to allow cutting means to pass to cut said unwound strip of textile material.

4. A needling machine according to claim 3, wherein said unwound strip of textile material is kept in contact with said helical chute while it is being fed to said needling table by two separate drive assemblies disposed respectively upstream and downstream from said means for cutting said unwound strip of textile material.

5. A needling machine according to claim 4, further including, downstream from said downstream drive assembly, a jockey roller hinged to said frame and designed to guarantee regular tension on said unwound strip of textile material after it has been cut by said cutting means and before it is taken up on said needling table by said friction drive means.

6. A needling machine according to claim 4, wherein each of said drive assemblies comprises wheels placed one after another so as to fit closely to the helical shape of said feed chute for said unwound strip of textile material.

7. A needling machine according to claim 6, wherein each of said drive assemblies has at least two wheels each mounted on a support secured to said frame and connected to one another by a drive belt, at least one of said wheels in each assembly being connected to a motor and gear box unit by means of a universal joint.

8. A needling machine according to claim 1, wherein said assembly for unwinding said wound strip of textile material includes a plurality of conical rollers rotated by friction from a ring centered on wheels secured to said frame and rotated by a belt driven by a motor, and on which said wound strip of textile material rests once said storage drum has been installed on said machine.

9. A needling machine according to claim 8, wherein said assembly for unwinding said wound strip of textile material further includes a presser roller held against one of said conical drive rollers by a resilient element acting in traction so as to enable a free end of said unwound strip of textile material to be taken up and guided towards said helical chute.

10. A needling machine according to claim 8, wherein said storage drum comprises a central hub having an axis of rotation C, with a series of fins being fixed to the bottom thereof (drum bottom) to form a perforated reception tray for receiving said conical rollers in the openings left between the fins to drive said wound strip of textile material.

* * * * *